US006220949B1

(12) United States Patent
Hayashi et al.

(10) Patent No.: US 6,220,949 B1
(45) Date of Patent: Apr. 24, 2001

(54) GRINDING BODY FOR ON-LINE ROLL GRINDING

(75) Inventors: Kanji Hayashi, Hiroshima; Makoto Suzuki, Chiba; Hiroshi Katagiri, Nagoya, all of (JP)

(73) Assignees: Mitsubishi Heavy Industries, Ltd., Tokyo; Kawasaki Steel Corporation, Hyogo; Noritake Co., Limited, Tokyo, all of (JP)

( * ) Notice: Subject to any disclaimer, the term of this patent is extended or adjusted under 35 U.S.C. 154(b) by 0 days.

(21) Appl. No.: 09/365,714

(22) Filed: Aug. 3, 1999

(30) Foreign Application Priority Data

Aug. 5, 1998 (JP) ..... 10-221548

(51) Int. Cl.[7] ..... B23F 21/03

(52) U.S. Cl. ..... 451/548; 451/541; 451/359; 451/259; 451/178

(58) Field of Search ..... 451/541, 544, 451/546, 548, 353, 358, 359, 178, 259, 550

(56) References Cited

U.S. PATENT DOCUMENTS 4,137,516 * 1/1979 Shaw et al. ..... 451/541
4,549,372 * 10/1985 Sexton et al. ..... 451/541
5,495,844 * 3/1996 Kitajima et al. ..... 451/541

FOREIGN PATENT DOCUMENTS 62-95867U 6/1987 (JP) .
647654A 2/1994 (JP) .
6320431A 11/1994 (JP) .
6335849A 12/1994 (JP) .
91463 1/1997 (JP) .
B22708351 10/1997 (JP) .

* cited by examiner

*Primary Examiner*—Eileen P. Morgan

(57) ABSTRACT

A grinding body for on-line roll grinding has a grindstone of a cup shape. The grindstone is on a surface portion, and near a peripheral edge, of a circular support base plate, so that a peripheral edge portion of the circular support base plate has on a surface side thereof a two-layer structure. This two-layered structure includes a flat ring-shaped portion jutting toward an inner periphery so as to define a groove opening inward. The grindstone is mounted on the flat ring-shaped portion; and a damping material is filled and mounted into the groove. This grinding body can effectively prevent the formation of a spiral mark and a pitching surface mark, improve the grinding power and grinding accuracy, and prolong the life of the grindstone.

5 Claims, 15 Drawing Sheets

[Damping material present]

[Damping material absent]

[Damping material present]

[Damping material absent]

○="Satisfactory"; no pitching surface mark
△="Allowable"; faint pitching surface mark
●="Poor"; deep pitching surface mark (Enlarged view)

GRINDING BODY FOR ON-LINE ROLL GRINDING

BACKGROUND OF THE INVENTION

1. Field of the Invention

The present invention relates to a grinding body for an on-line roll grinding device which is mounted and used on a rolling mill.

2. Description of the Related Art

When on-line roll grinding is performed, it is common practice, as shown in FIG. 16, that a plurality of on-line roll grinding devices 20 are placed to face a roll 21 to be ground, each of the on-line roll grinding devices 20 having a grinding body 22 capable of reciprocating in an axial direction of the roll 21 and rotatable along the axial direction, and the grinding body 22 is pressed against a surface of the roll 21, which is rotating, to grind the surface of the roll 21. A shaft center 20*a* of the grinding device 20 is set at the same height as an axis 21*a* of the roll 21, or at a height displaced upward or downward (an offset height H) by a certain distance from the axis 21*a*. The shaft center 20*a* of the grinding device 20 is also set to be horizontally inclined at an angle of $\alpha$ (e.g., 0.5°) from a line 20*b* perpendicular to the axis 21*a* of the roll 21. This angle of inclination, $\alpha$, is called a grindstone pressing angle.

Such grinding of the roll 21 with the grinding device 20 is known to pose the following problems: The offset height H and the grindstone pressing angle $\alpha$ that have been set vary because of wear of the roll 21 by rolling, or owing to adjustment of a gap between the upper and lower rolls 21 and 21. Thus, the grindstone contacts the surface of the roll 21 unevenly, forming a spiral mark and deteriorating the roll surface. Eventually, the roll becomes unusable. Furthermore, roughening of the surface of the roll 21, and vibrations of the roll 21 due to an increased gap between the roll surface and the grinding body 22, cause the vibration of the grinding body 22, thereby forming a pitching surface mark 23 with a streaked pattern, as shown in FIG. 17, on the surface of the roll 21 to be ground. Rotary grinding bodies for preventing the formation of the pitching surface mark 23 or the spiral mark were proposed by ① Japanese Unexamined Patent Publication No. 6-47654 (hereinafter referred to as the earlier technology I) ② Japanese Unexamined Patent Publication No. 9-1463 (hereinafter referred to as the earlier technology II), and ③ Japanese Unexamined Utility Model Publication No. 62-95867 (hereinafter referred to as the earlier technology III).

The earlier technology I, as shown in FIGS. 18 to 19, tries to prevent the formation of the pitching surface mark 23 by securing a thin grindstone 32 onto a flexible, thin, circular base plate 31 having a central portion rotatably supported to constitute a low-rigidity grinding body 22, and absorbing vibrations of the roll 21, during grinding, by local warpage of the thin, circular base plate 31 of the grinding body 22 pressed against the roll 21. FIG. 20 shows a state in which only an outer edge of the grindstone 32 contacts the roll 21, so that the thin, circular base plate 31 warps, thus bringing the entire width of the grindstone into contact with the roll 21. FIG. 21 shows a state in which only an inner edge of the grindstone 32 contacts the roll 21.

The earlier technology II focuses on the fact that when the grinding body of the earlier technology I contacts the roll 21 at a circumferential portion of the thin grindstone 32, as shown in FIG. 21, only the warpage of the thin circular base plate 31 is not enough to resolve the uneven contact. In light of this fact, the earlier technology II, as shown in FIGS. 22 to 25, secures a cup-shaped grindstone 42 onto a circular base plate 41 having an inward groove 43 defined by a circumferential portion of the circular base plate 41 bent on a surface side, thereby constituting a grinding body. Making use of the groove 43, the earlier technology II attempts to resolve the contact of only the outer edge or the inner edge of the cup-shaped grindstone 42 with the roll surface, thereby preventing the formation of the spiral mark.

The earlier technology III, as shown in FIGS. 26 to 27, tries to prevent the formation of the pitching surface mark by fixing a cup-shaped grindstone 52 having a bottom plate to a circular base plate 51 by means of a nut 55, with the bottom plate being sandwiched between rubber plates 53 and 54 (FIG. 26), or fixing a bottom plate of a cup-shaped grindstone 52 to a circular base plate 51 by means of a nut 55, with a rubber plate 53 being sandwiched therebetween (FIG. 27), so that vibrations of the roll 21 will be absorbed by the rubber plate 53 (54).

With the grinding body of the earlier technology I, the pitching surface mark 23 has been assumed to occur because of vibrations of the roll 21 during on-line grinding. As a countermeasure, the circular base plate has been thinned to impart low rigidity to the grinding body. However, the thinning of an abrasive grain layer and a support portion (collectively called a grindstone) to impart low rigidity because of emphasis on flexibility involves the following problems:

(1) Vibrations occurring in the grinding body 22 during grinding include resonance vibrations associated with vibrations of the roll 21, and self-excited vibrations associated with stick-slips at the interface between the grindstone and the roll 21 in contact with each other. The self-excited vibrations occur because of the low dynamic stiffness of the support member for the grindstone, i.e., the circular base plate. The self-excited vibrations lead to the formation of the pitching surface mark 23.

(2) Since the support member for the grindstone is a flexible, thin, circular base plate, uneven contact of the grindstone with the roll is liable to occur, under a high grinding force, according to changes in roll setting. Thus, the oscillating speed and the grinding force are restricted, so that the grinding power declines.

(3) If the thickness of the abrasive grain layer secured to the thin circular base plate differs, the rigidity of the grindstone also varies. FIG. 13 is a graph showing the relationship between the thickness of a grindstone and the rigidity of the grindstone. As a one-dot chain line in the drawing indicates, decreases in the grindstone thickness result in rapid decreases in the grindstone rigidity. Thus, the accuracy of grinding lowers according to changes in the rigidity of the grindstone.

To retain the grindstone rigidity, the abrasive grain layer can be thickened only up to a predetermined thickness. Thus, the life of the grindstone shortens.

(4) When the grindstone supported on the flexible thin circular base plate is pressed against the roll with a predetermined pressing force, local warpage occurs, and the stress of the grindstone at the site of warpage increases. Thus, the pressing force is limited to a level at which the imposed stress is below the allowable grindstone stress. Consequently, the grinding power is restricted. FIG. 14 is a graph showing the relationship between the grindstone pressing force and the grindstone stress. As indicated by a one-dot chain line in the drawing, the imposed stress exceeds the allowable grindstone stress when the pressing force is about 50 kgf or more.

(5) To reduce the weight of the rotary movable portion, the abrasive grain layer needs to be thinned. Since the thickness of the abrasive grain layer is thus restricted, the life of the grindstone becomes short.

With the earlier technology II, special deformation of the grooved circular base plate 41 has resolved uneven contact of the grindstone with the roll. However, the pitching surface mark associated with self-excited vibrations, the problem with the earlier technology I, has not been resolved.

According to the earlier technology III, the pitching surface mark has considerably been diminished because of the effect of the rubber plate. However, its diminution has not been complete. The reason is that the inserted rubber plates 53 and 54 are exposed to the outside, so that the damping effect of rubber has not been fully exhibited owing to the penetration of foreign matter or the deterioration of rubber.

SUMMARY OF THE INVENTION

The present invention has been accomplished in view of the above-described problems. It is an object of the invention to provide a grinding body for on-line roll grinding, which can effectively prevent the formation of a spiral mark and a pitching surface mark, which can improve the grinding power and grinding accuracy, and which can prolong the life of a grindstone.

To attain the above object, an aspect of the present invention claims a grinding body for on-line roll grinding, comprising a grindstone mounted in a cup shape on a surface portion, and near a peripheral edge, of a circular support base plate, wherein:

a peripheral edge portion of the circular support base plate has on a surface side thereof a two-layer structure including a flat ring-shaped portion jutting toward an inner periphery so as to define a transverse groove-like gap opening inward;

the grindstone is mounted on the flat ring-shaped portion; and a damping material is filled and mounted into the transverse groove-like gap.

According to this aspect of the invention, the uneven contact of the grindstone with the roll is resolved during roll grinding, the formation of a spiral mark on the roll surface is resolved, the oscillating speed of the grinding body can be increased, the grinding force is not restricted, and the grinding power can be improved. Vibration energy generated in the grindstone is mostly absorbed to the damping material filled into the groove, and transmitted to the circular support base plate. As a result, self-excited vibrations in the grinding body associated with stick-slips at the interface between the grindstone and the roll in contact with each other are markedly reduced, and the formation of a pitching surface mark on the roll surface due to the self-excited vibrations is resolved.

Preferably, an opening of the transverse groove-like gap filled and mounted with the damping material is sealed with a waterproof joint filler. This sealing can prevent the penetration of foreign matter, and protect the damping material, thus preventing the deterioration of the grinding body.

Another aspect of the invention is a grinding body for on-line roll grinding, comprising a grindstone mounted in a cup shape on a surface portion, and near a peripheral edge, of a circular support base plate, wherein:

a peripheral edge portion of the circular support base plate has on a surface side thereof a two-layer structure including a flat ring-shaped portion jutting toward an inner periphery so as to define a transverse groove-like gap opening inward;

a plate thickness, c, of the flat ring-shaped portion as one of two layers of the two-layer structure, and a plate thickness, b, of the other layer of the two-layer structure, with the transverse groove-like gap being sandwiched between the two layers, is in a relation, $b<c$;

the grindstone is mounted on the flat ring-shaped portion with the plate thickness c; and a damping material is filled and mounted into the transverse groove-like gap.

According to this aspect of the invention, the flat ring-shaped portion with a large thickness minimally deforms during roll grinding, and excessive stress does not occur in the grindstone (including its mating surface). Thus, an increase in the grindstone pressing force can enhance the grinding power. Furthermore, even if the thickness of the grindstone varies, the rigidity of the grindstone minimally changes, and the grinding accuracy can be retained. In addition, the abrasive grain layer can be thickened to prolong the life span of the grindstone until its replacement.

Preferably, an opening of the transverse groove-like gap filled and mounted with the damping material is sealed with a waterproof joint filler. This sealing can prevent the penetration of foreign matter, and protect the damping material, thus preventing the deterioration of the grinding body.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

PREFERRED EMBODIMENTS OF THE INVENTION

A grinding body for on-line roll grinding according to the present invention will now be described in detail by way of the following Embodiments with reference to the accompanying drawings, but it should be understood that the invention is not restricted thereby.

[First Embodiment]

Constitution

Figure 1:
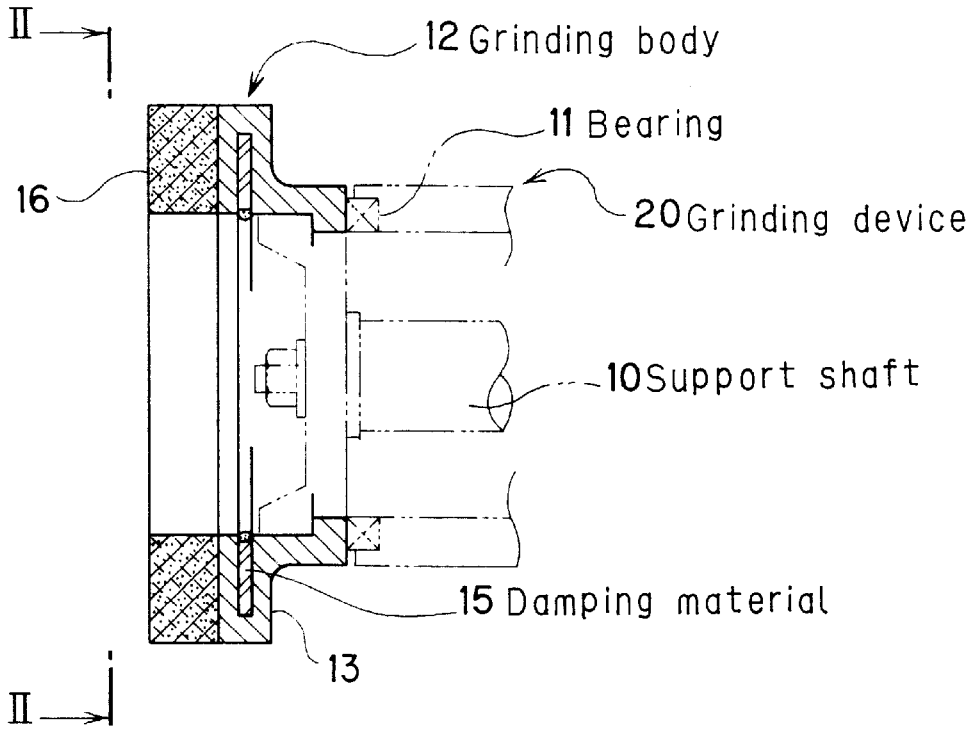
FIG. 1 is a vertical sectional side view of a grinding body according to a first embodiment of the present invention.
Figure 2:
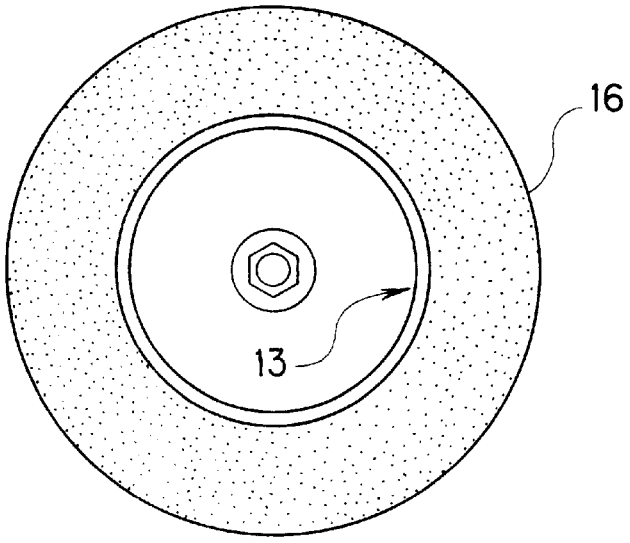
FIG. 2 is a view taken on line II—II of FIG. 1.
Figure 3:
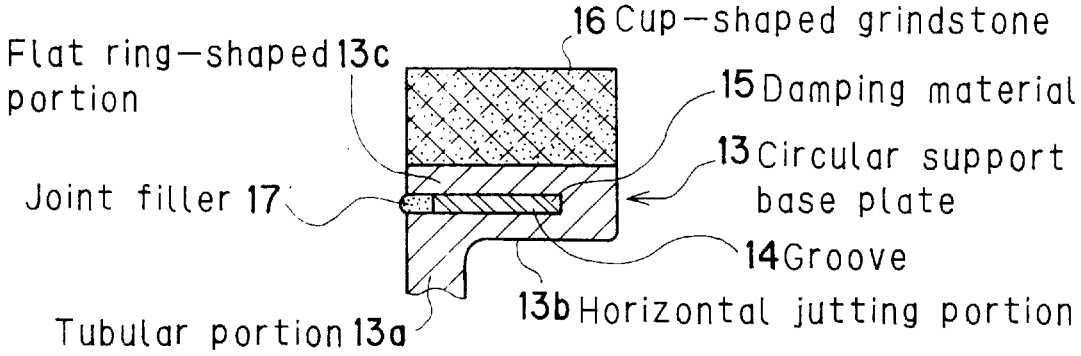
FIG. 3 is a partly enlarged view of FIG. 1.

In FIGS. 1 to 3, the reference numeral 12 denotes a grinding body having a central portion and a peripheral edge portion rotatably supported by a support shaft 10 and a bearing 11 of an on-line roll grinding device 20. The grinding body 12 is composed of a circular support base plate 13 of a metal, such as SUS, constructed in a two-layer structure from a horizontal jutting portion 13*b* and a flat ring-shaped portion 13*c*, the horizontal jutting portion 13*b* jutting outward from a short tubular portion 13*a*, and the flat ring-shaped portion 13*c* extending upward and then toward a central side from an outer peripheral edge portion of the horizontal jutting portion 13*b* in such a manner as to be opposed to the horizontal jutting portion 13*b* while defining a transverse groove 14 opening toward the central side; a damping material 15 filled into the groove 14; and an integral, cup-shaped grindstone 16 secured onto a surface of the flat ring-shaped portion 13*c*. The reference numeral 17 denotes a joint filler, such as a waterproof silicone material, provided to seal an opening of the groove 14 when the damping material 15 is not waterproof. As the damping material 15, a vibration absorbing rubber member, such as a sand-containing one, or a damper is used.

Actions and Effects

Figure 4:
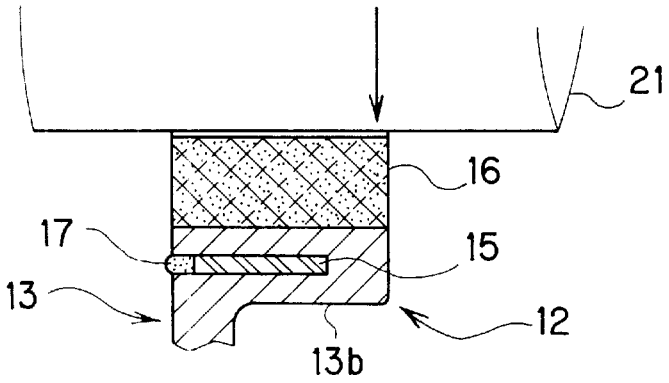
FIG. 4 is a sectional view showing a state of contact of only an outer portion of a cup-shaped grindstone with a roll.

When only an outer end of the cup-shaped grindstone 16 of the grinding body 12 contacts a surface of a roll 21, and is pressed against it, as shown in FIG. 4, the horizontal jutting portion 13*b* below the groove 14 in the circular support base plate 13 warps outwardly downwardly. Thus, the entire width of the cup-shaped grindstone 16 contacts the surface of the roll 21. In this state, the grinding body 12 rotates.

Figure 5:
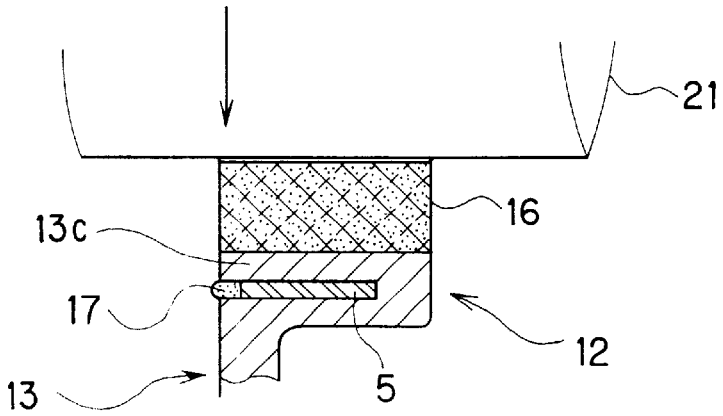
FIG. 5 is a sectional view showing a state of contact of only an inner portion of a cup-shaped grindstone with a roll.

When only an inner end of the cup-shaped grindstone 16 of the grinding body 12 contacts the surface of the roll 21, and is pressed against it, as shown in FIG. 5, the flat ring-shaped portion 13*c* above the groove 14 in the circular support base plate 13 warps inwardly downwardly. Thus, the entire width of the cup-shaped grindstone 16 contacts the surface of the roll 21. In this state, the grinding body 12 rotates.

Under these actions, the uneven contact of the grindstone 16 with the surface of the roll 21 is resolved. Thus, the formation of a spiral mark on the roll surface is resolved, the oscillating speed of the grinding body can be increased, the grinding force is not restricted, and the grinding power can be enhanced.

In this state, vibration energy occurring in the cup-shaped grindstone 16 is mostly absorbed to the damping material 15 filled into the groove 14, and transmitted to the circular support base plate 13. As a result, self-excited vibrations in the grinding body 12 associated with stick-slips at the interface between the cut-shaped grindstone 16 and the roll 21 in contact with each other are markedly reduced, and the formation of a pitching surface mark 23 on the surface of the roll 21 due to the self-excited vibrations is resolved.

Figure 6A:
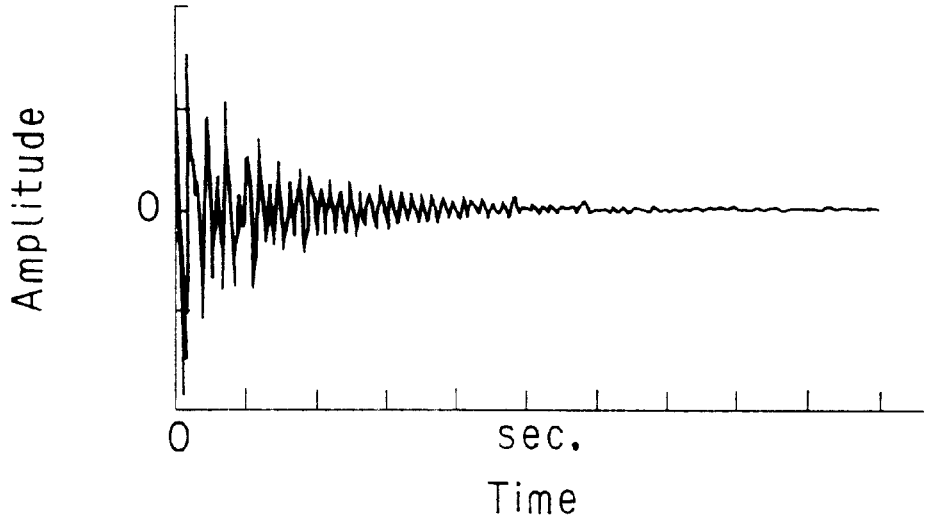
FIGS. 6(*a*) and 6(*b*) are graphs for comparing the vibration waveform of a grindstone in the present invention with that in the earlier technology.
Figure 6B:
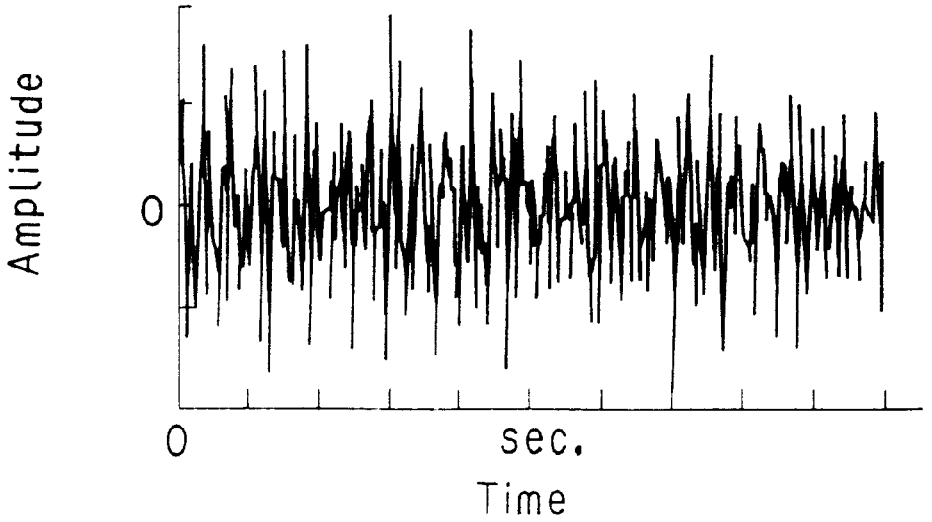

FIGS. 6(*a*) and 6(*b*) show the results of a hammering test conducted to compare a vibration waveform occurring in the grinding body (a) when the damping material 15 is provided in the groove 14 as in the present invention, and (b) when the damping material 15 is absent as in the earlier technology II, but with the same constitution provided. In these drawings, the vertical axis represents the amplitude relative to a reference line 0, while the horizontal axis represents the passage of time in seconds. In the absence of the damping material 15(*b*), vibrations under an external force continue at the same amplitude. In the presence of the damping material 15(*a*), it is clear that the amplitude is rapidly attenuated.

Figure 7A:
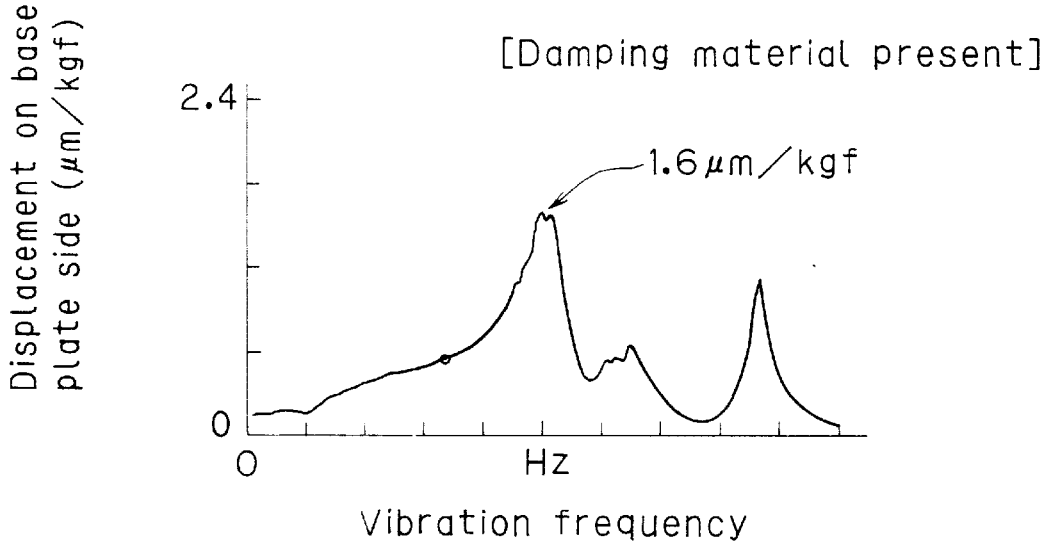
FIGS. 7(*a*) and 7(*b*) are graphs for comparing the dynamic stiffness (compliance) of a grindstone in the present invention with that in the earlier technology.
Figure 7B:
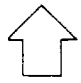
Figure 7B:
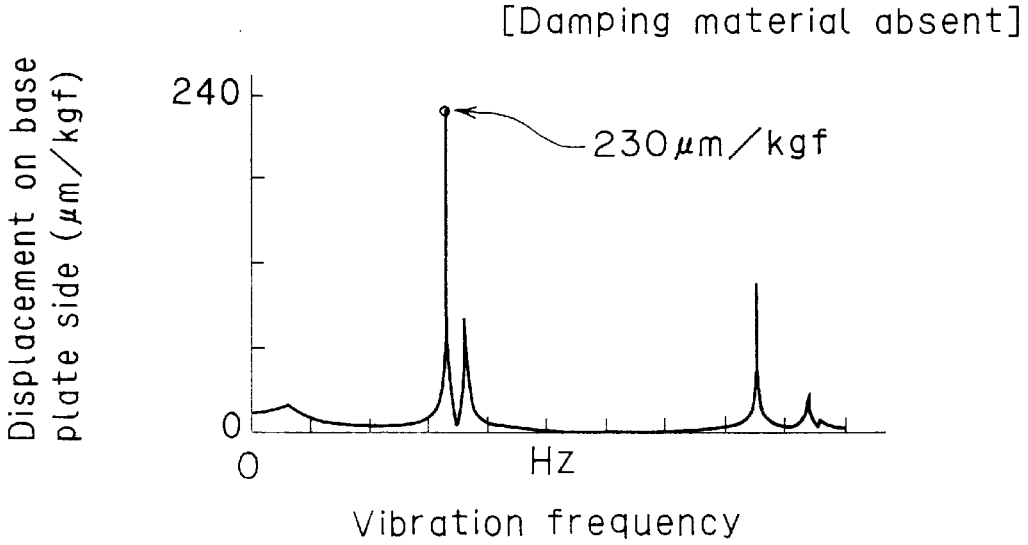

FIGS. 7(*a*) and 7(*b*) show the results of a hammering test conducted to compare displacement under unit load (compliance) which occurs for each vibration frequency, i.e., dynamic stiffness, in the circular support base plate 13 (grinding body), (a) when the damping material 15 is used, and (b) when the damping material 15 is not used. In these drawings, the vertical axis represents the vibration frequency in Hz, while the horizontal axis represents the displacement of the circular support base plate in $\mu$m/kgf at a major ratio (b)/(a)=100/1. In the absence of the damping material 15(*b*), displacement of about 230 $\mu$m/kgf appears at maximum resonance. In the presence of the damping material 15(*a*), displacement at maximum resonance is about 1.6 $\mu$m/kgf. Thus, the dynamic stiffness of the circular support base plate increases under the action of the damping material 15, and the displacement of the circular support base plate markedly decreases to about 1/100 of the value obtained for (b). Thus, a damping effect can be obtained.

Furthermore, an opening of the groove 14 mounted with the damping material 15 is sealed with the joint filler 17. This sealing can prevent the penetration of foreign matter, and protect the damping material 15, thus preventing the deterioration of the grinding body.

Figure 8A:
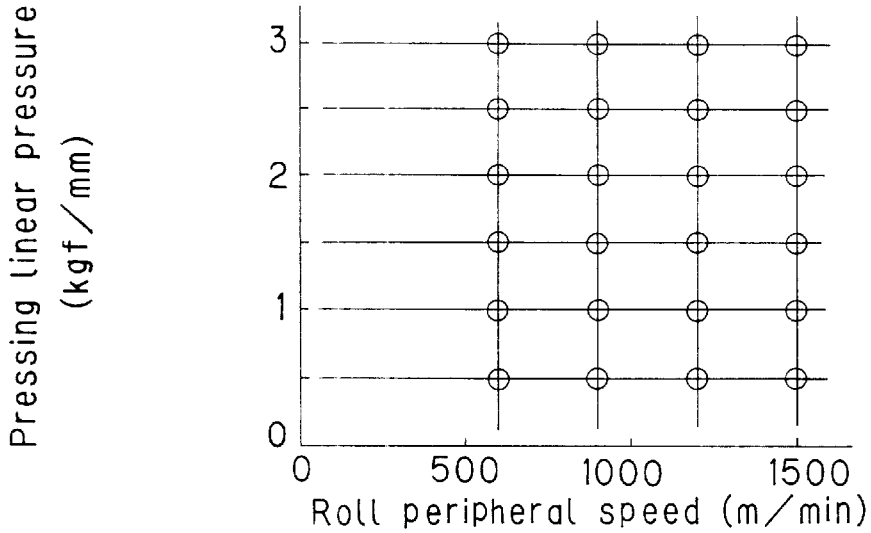
FIGS. 8(*a*) and 8(*b*) are graphs for comparing the status of a pitching surface mark in the present invention with that in the earlier technology.
Figure 8B:
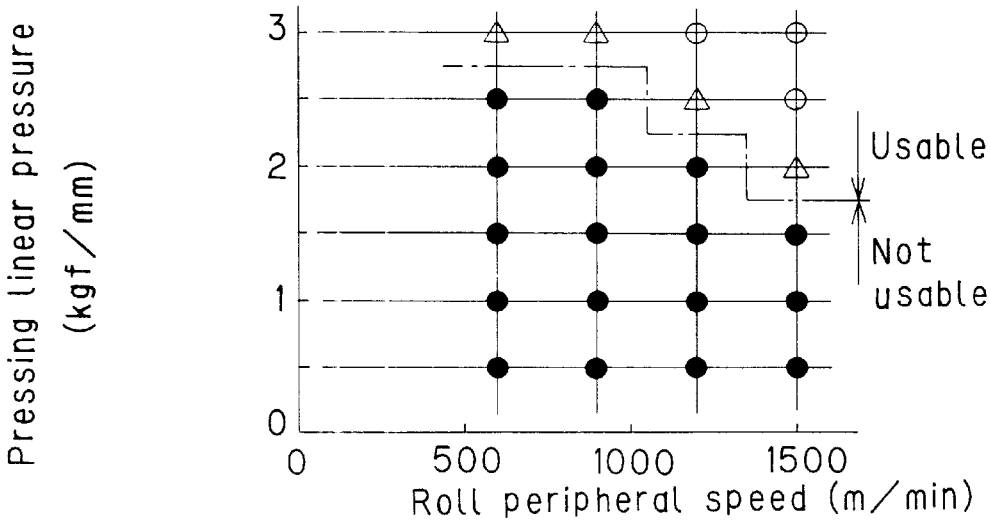

FIGS. 8(*a*) and 8(*b*) show the results of investigation into the status of a pitching surface mark under on-line grinding conditions (a) when the damping material 15 is used, and (b) when the damping material 15 is not used. In these drawings, the horizontal axis represents the peripheral speed of the roll (m/min), while the vertical axis represents the grindstone pressing linear pressure (kgf/mm). In experiments, on-line grinding operation was performed for a constant period of time at roll peripheral speeds of 600 m/min, 900 m/min, 1200 m/min and 1500 m/min under a grindstone pressing linear pressure varied from 0.5 kgf/mm to 3 kgf/mm with a pitch of 0.5 kgf/mm. The status of a pitching surface mark was evaluated visually under the following criteria:

No pitching surface mark occurred="Satisfactory" ○

A faint pitching surface mark occurred="Allowable" Δ

A clear pitching surface mark occurred="Poor" ●

The results of FIGS. 8(*a*) and 8(*b*) demonstrate that the constitution of the present invention combined with the damping material 15 resolves the formation of a pitching surface mark which has occurred with the earlier technologies.

[Second Embodiment]

Constitution

This embodiment is the preceding First Embodiment, but with the constitution of the circular support base plate 13 being partially changed such that the plate thickness b of the horizontal jutting portion 13*b* and the plate thickness c of the flat ring-shaped portion 13*c* will be in the relationship b<c. The same members as in the First Embodiment are assigned the same numerals, and their detailed explanations are omitted.

Figure 9:
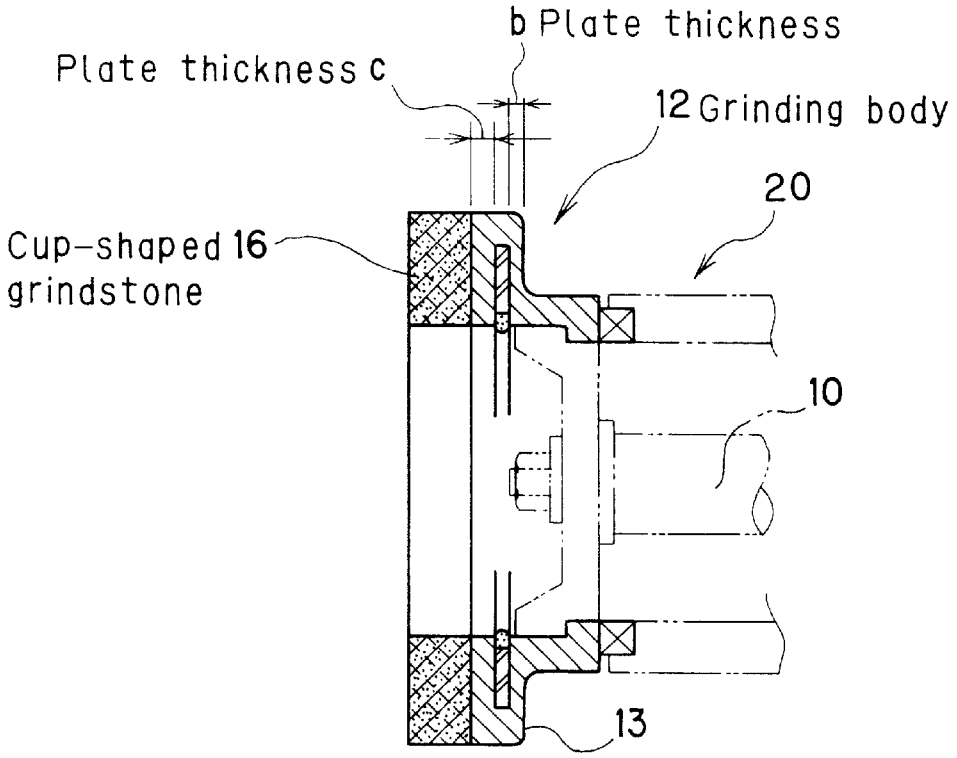
FIG. 9 is a vertical sectional side view of a grinding body according to a second embodiment of the present invention.
Figure 10:
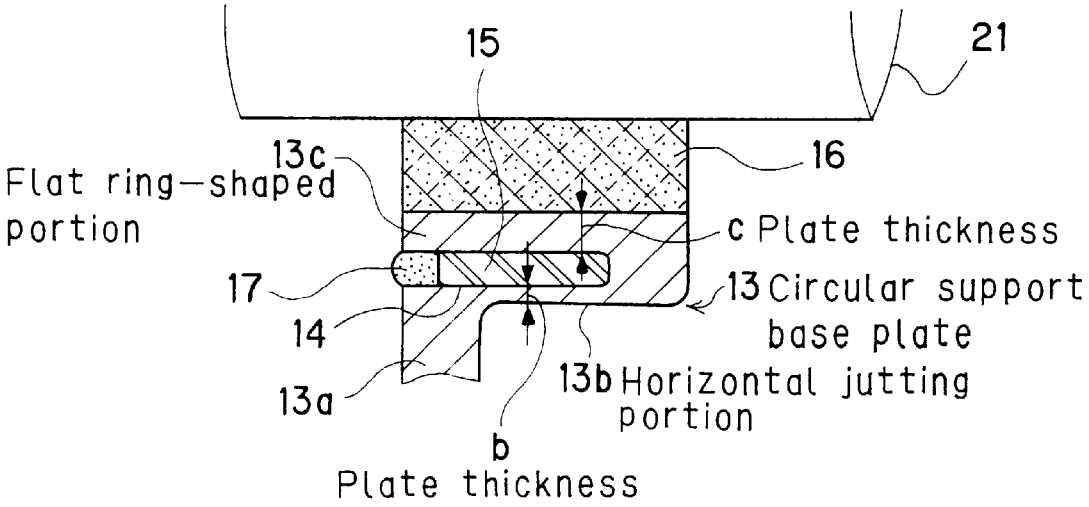
FIG. 10 is a partly enlarged view of FIG. 9.

In FIGS. 9 to 10, dimensions for the plate thickness in the circular support base plate 13 are set such that the plate thickness c of the flat ring-shaped portion 13*c* is greater than the plate thickness b of the horizontal jutting portion 13*b*, i.e., b<c. Along with this configuration, the thickness of the cup-shaped grindstone 16 can be made greater than before, e.g., can be increased to about 20 to 30 mm. Other constituent features of the grinding body are nearly the same as in the First Embodiment, and their explanations are omitted.

Actions and Effects

The surface of the grindstone 16 secured to the flat ring-shaped portion 13*c* grinds the surface of the roll 21 while rotating in contact with the roll 21. During this grinding, the force, with which the grindstone is pressed against the roll, imposes a warping, deforming force on the circular support base plate 13. As stated above, the plate thickness b of the horizontal jutting portion 13*b* and the plate thickness c of the flat ring-shaped portion 13*c* are set in the relation b<c. Thus, the flat ring-shaped portion 13*c* given a great plate thickness minimally deforms, while only the horizontal jutting portion 13*b* with a small plate thickness warps and deforms.

Figure 11:
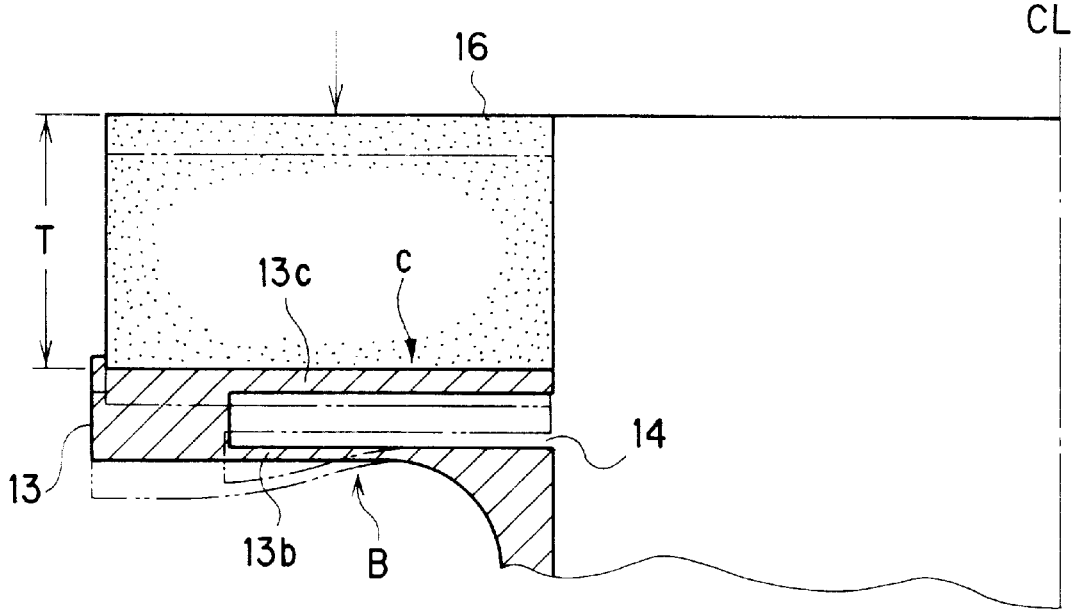
FIG. 11 is an explanation drawing showing the state of warpage of a circular support base plate of the grinding body as the second embodiment of the present invention.
Figure 12:
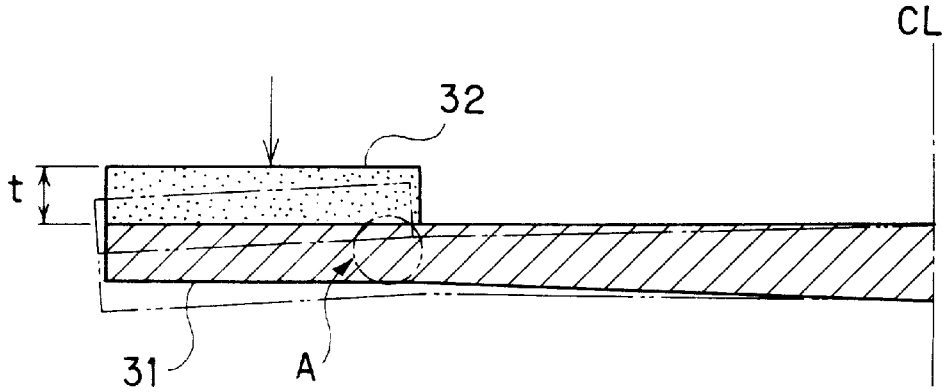
FIG. 12 is an explanation drawing showing the state of warpage of a circular support base plate of a grinding body according to the earlier technology I.

FIG. 11 illustrates these situations found by FEM analysis. When an external force is exerted on a grinding surface of the grindstone 16 (its upper surface in the drawing), the circular support base plate 13 warps and deforms from a state indicated by a solid line to a state indicated by a one-dot chain line. As this deformation shows, deformation at a site B is predominant, and there is no local deformation at a site C. Thus, no overstress occurs in the grindstone 16 (including its mating surface). With the earlier technology I shown in FIG. 12, by contrast, excessive stress may occur in the boundary line A between the circular base plate 31 and the grindstone 32, damaging the grindstone 32.

Figure 15A:
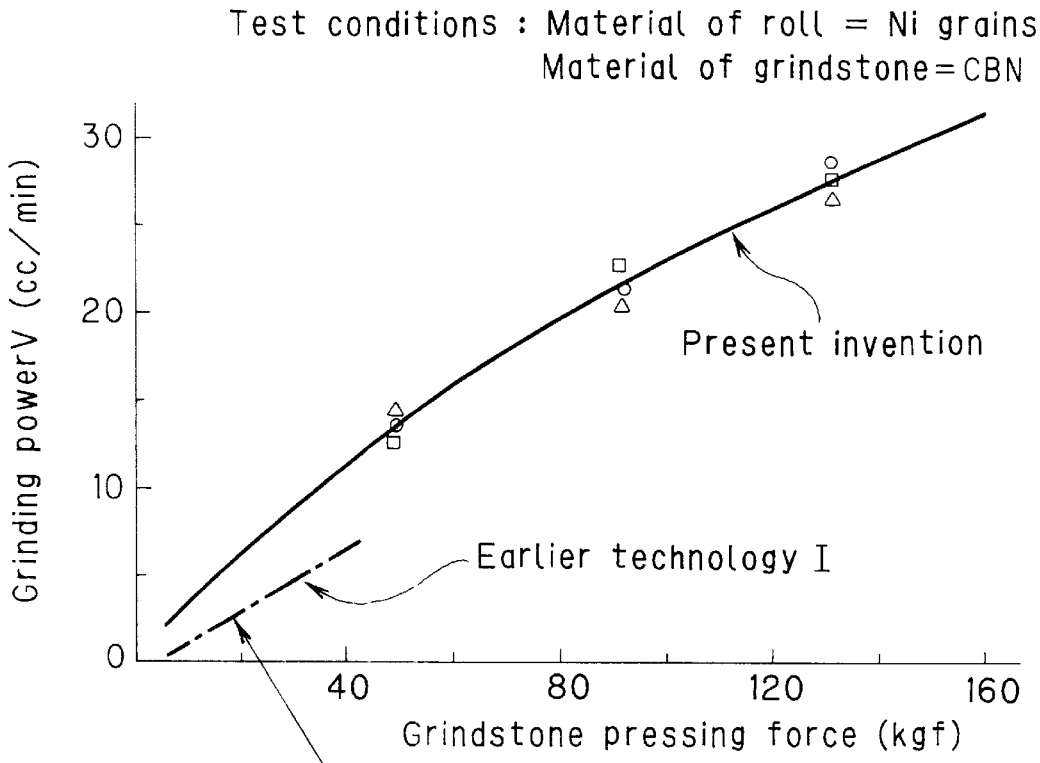
FIGS. 15(*a*) and 15(*b*) are graphs showing the relationship between the pressing force of a grindstone and grinding power in each of the present invention and the earlier technology I.
Figure 15B:
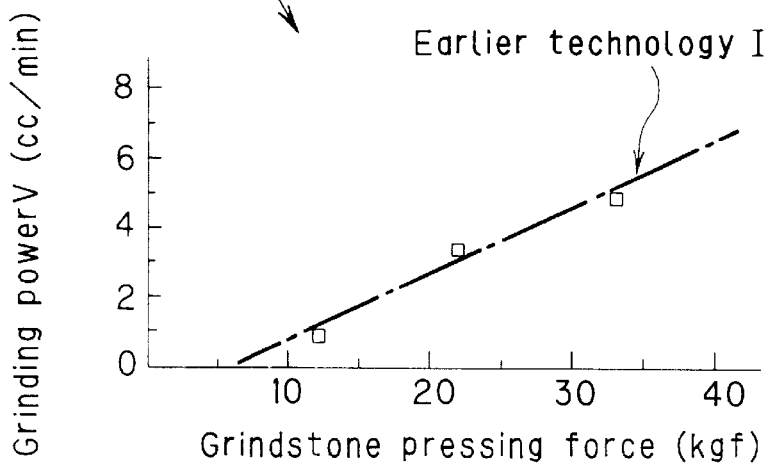
Figure 16:
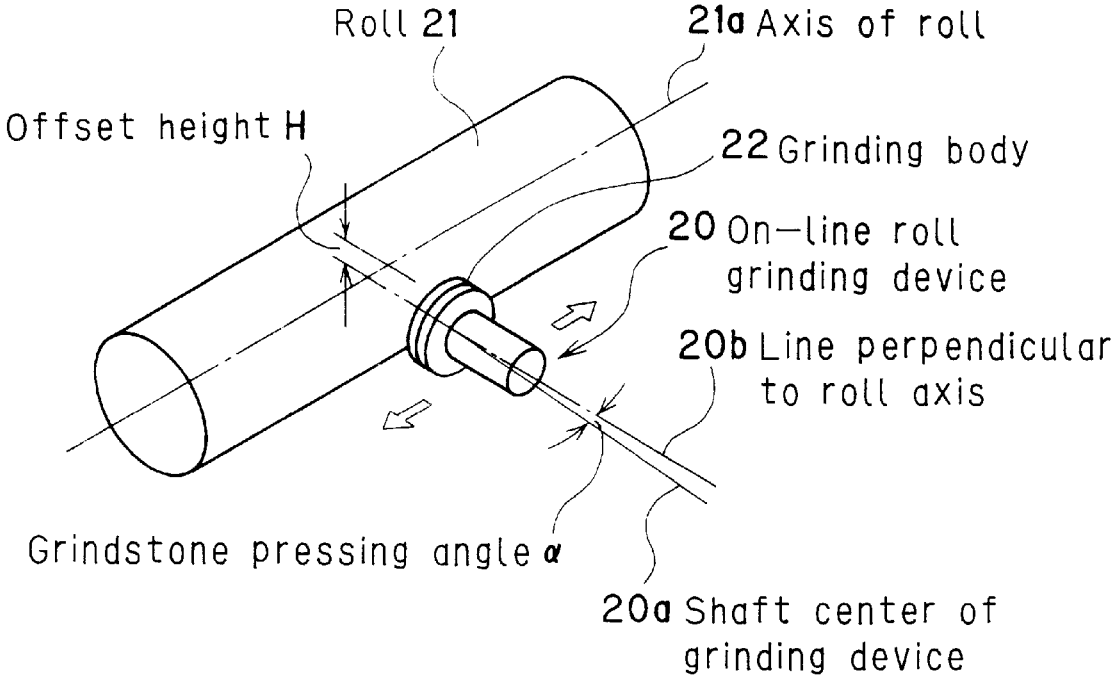
Fig.16 Related Art
FIG. 16 is a perspective view showing the situation of on-line roll grinding.
Figure 17:
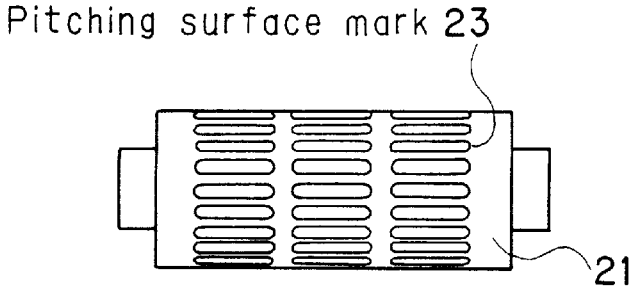
Fig.17 Related Art
FIG. 17 is a side view of a roll.
Figure 18:
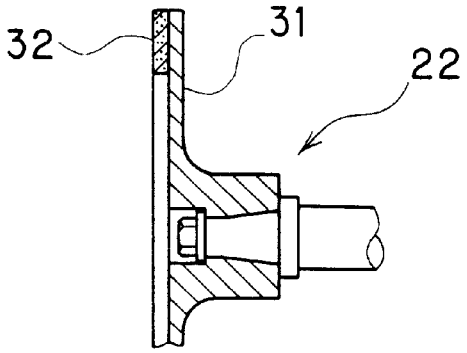
Fig.18 Related Art
FIG. 18 is a side sectional view of a conventional grinding body.
Figure 19:
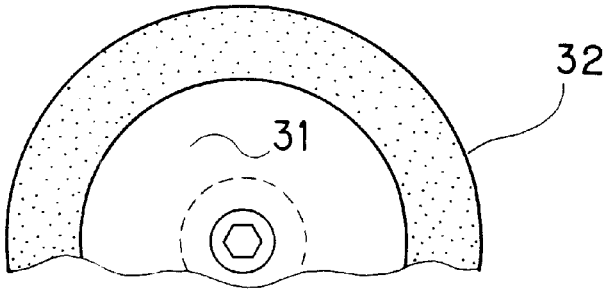
Fig.19 Related Art
FIG. 19 is a front view of the conventional grinding body.
Figure 20:
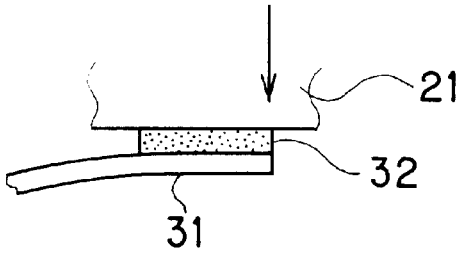
Fig.20 Related Art
FIG. 20 is a view showing an operating state of the conventional grinding body.
Figure 21:
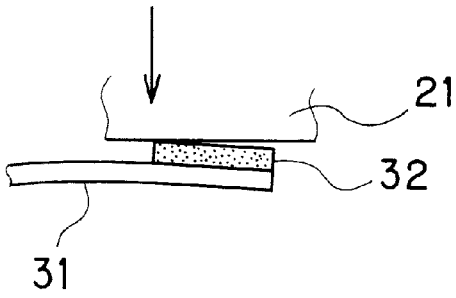
Fig.21 Related Art
FIG. 21 is a view showing a different operating state of the conventional grinding body.
Figure 22:
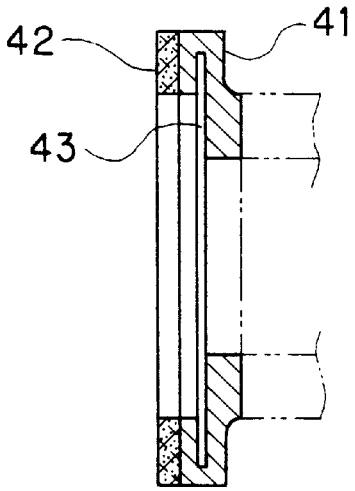
Fig.22 Related Art
FIG. 22 is a side sectional view of a different conventional grinding body.
Figure 23:
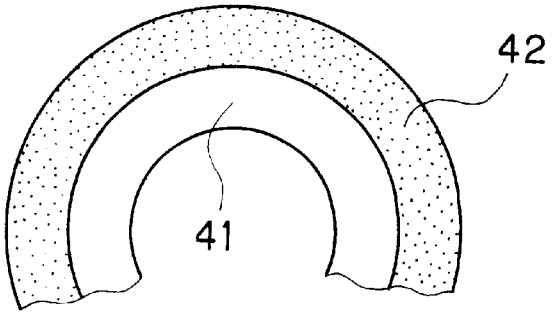
Fig.23 Related Art
FIG. 23 is a front view of the different conventional grinding body.
Figure 24:
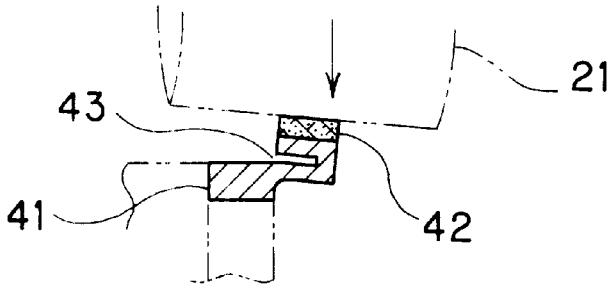
Fig.24 Related Art
FIG. 24 is a view showing an operating state of the different conventional grinding body.
Figure 25:
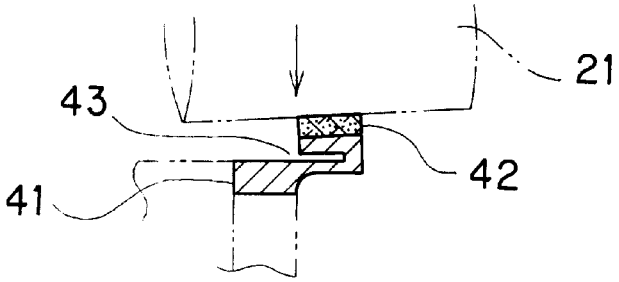
Fig.25 Related Art
FIG. 25 is a view showing a different operating state of the different conventional grinding body.
Figure 26:
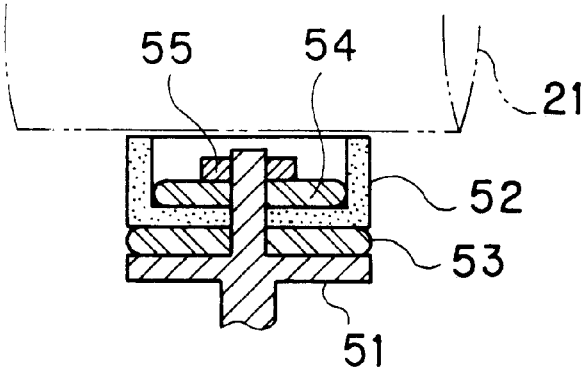
Fig.26 Related Art
FIG. 26 is a sectional plan view of a further different conventional grinding body.
Figure 27:
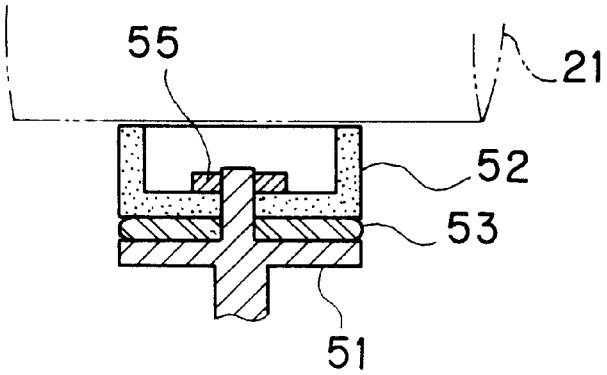
Fig.27 Related Art
FIG. 27 is a sectional plan view of a modified conventional grinding body.

FIG. 15(*a*) shows the results of experiments for measuring the grinding power per unit time versus the grindstone pressing force for the present invention (solid line) and the earlier technology I (one-dot chain line). FIG. 15(*b*) is an enlarged view of FIG. 15(*a*) for the earlier technology I (one-dot chain line) In these experiments, grinding was performed, using a roll of nickel grains and a grindstone of CBN, at a roll peripheral speed of 600 m/min and an oscillating speed of a grinding device of 30 m/sec to 80 m/sec. The amount of grinding per unit time was measured at a plurality of points with different magnitudes of the grindstone pressing force. In the case of the earlier technology I indicated by the one-dot chain line in the drawings, experiments were performed under the same conditions, with the grindstone pressing force restricted to a practical range of 40 kgf or less. Similarly, the amount of grinding per unit time was measured at a plurality of points with different magnitudes of the grindstone pressing force.

Figure 13:
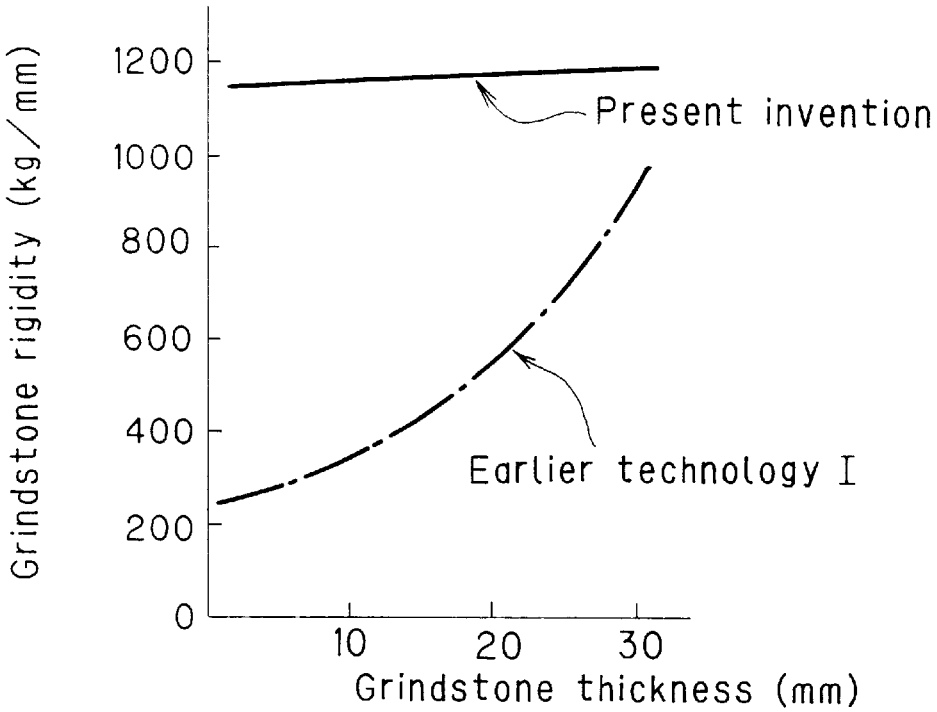
FIG. 13 is a graph showing the relationship between the thickness and rigidity of a grindstone in each of the present invention and the earlier technology I.
Figure 14:
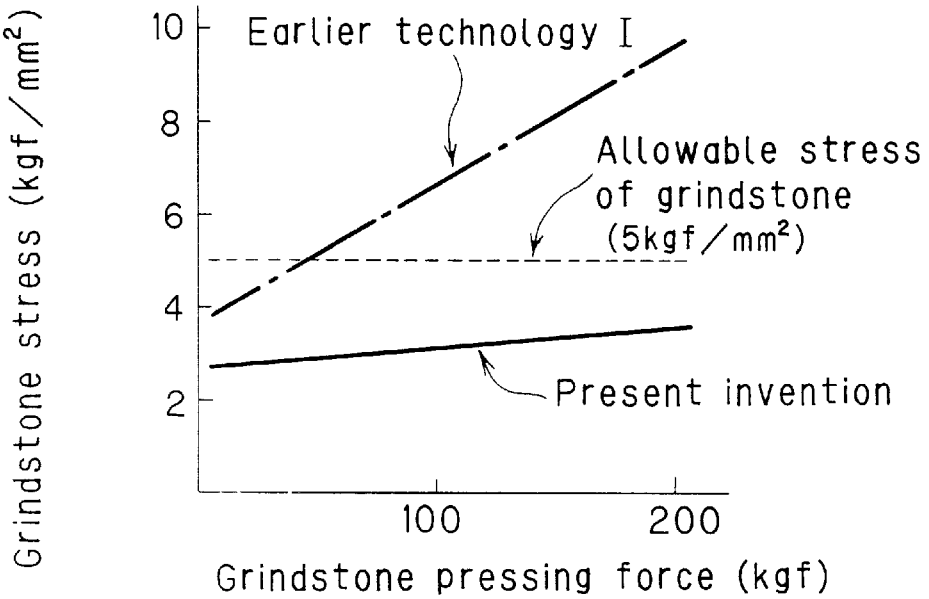
FIG. 14 is a graph showing the relationship between the pressing force and stress of a grindstone in each of the present invention and the earlier technology I.

According to the present invention, even when the grindstone pressing force is rendered high as shown by a solid line in FIG. 14, the stress of the grindstone remains within the grindstone allowable stress (indicated by a dashed line in the drawing). Thus, the grinding power can be enhanced by increasing the grindstone pressing force, as indicated by the solid line in FIG. 15(*a*). Furthermore, deformation at the site B in FIG. 11 is predominant, and there is no local deformation at the site C. As shown by the solid line in FIG. 13, therefore, even when the thickness of the grindstone varies, the rigidity of the grindstone minimally changes. Consequently, the grinding accuracy can be maintained. Besides, the absence of location deformation at the site C makes it possible to thicken the abrasive grain layer, thus prolonging the life span of the grindstone 16 until replacement.

This invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A grinding body for on-line roll grinding, comprising:

a cup shaped grindstone, a circular support base plate, the grindstone mounted on a surface portion and near a peripheral surface of the circular support plate, wherein:

a peripheral edge portion of the circular support base plate has on a surface side thereof a two-layer structure including a flat ring-shaped portion; and a damping material is filled and mounted into a transverse groove gap.

2. The grinding body for on-line roll grinding as claimed in claim 1, wherein an opening of the transverse groove gap filled and mounted with the damping material is sealed with a waterproof joint filler.

3. The grinding body for on-line roll grinding as claimed in claim 1, wherein the damping material is waterproof.

4. A grinding body for on-line roll grinding, comprising a cup shaped grindstone a circular support base plate, the grindstone mounted on a surface portion and near a peripheral surface of the circular support plate, wherein:

a peripheral edge portion of the circular support base plate has on a surface side thereof a two-layer structure including a flat ring-shaped portion jutting toward an inner periphery so as to define a transverse groove gap opening inward;

a plate thickness, c, of the flat ring-shaped portion as one of two layers constituting the two-layer structure, and a plate thickness, b, of the other layer of the two-layer structure, with the transverse groove gap being sandwiched between the two layers, is in a relation b<c;

the grindstone is mounted on the flat ring-shaped portion with the plate thickness c; and a damping material is filled and mounted into the transverse groove gap.

5. The grinding body for on-line roll grinding as claimed in claim 4, wherein an opening of the transverse groove gap filled and mounted with the damping material is sealed with a waterproof joint filler.

* * * * *